US005173355A

United States Patent [19]

Vock et al.

[11] Patent Number: 5,173,355

[45] Date of Patent: Dec. 22, 1992

[54] SPUN-BONDED FABRIC CONSOLIDATED BY A HOT-MELT BINDER

[75] Inventors: Günther Vock, Bobingen; Michael Schöps, Grossaitingen, both of Fed. Rep. of Germany

[73] Assignee: Hoechst Aktiengesellschaft, Frankfurt am Main, Fed. Rep. of Germany

[21] Appl. No.: 569,077

[22] Filed: Aug. 17, 1990

[30] Foreign Application Priority Data

Aug. 21, 1989 [DE] Fed. Rep. of Germany ..... 3927505
Sep. 9, 1989 [DE] Fed. Rep. of Germany ..... 3930100

[51] Int. Cl.[5] ..... D04H 3/14; D04H 3/16

[52] U.S. Cl. ..... 428/219; 428/288; 428/296; 428/297

[58] Field of Search ..... 428/296, 297, 219, 288

[56] References Cited

U.S. PATENT DOCUMENTS 4,518,658 5/1985 Baravian et al. ..... 428/296

*Primary Examiner*—James C. Cannon

[57] ABSTRACT

A spun-bonded fabric consolidated by a hot-melt binder, composed of polyester filaments and of polyester binder filaments serving as the hot-melt binder is described. The weight per unit area of the spun-bonded fabric is in the range between 20 and 120 g/m$^2$, the individual titer of the load-bearing filaments and of the binder filaments is in the range between 1 and 7 dtex, and the proportion of the binder filaments is less than 10 percent by weight. This is a lightweight spun-bonded fabric which is distinguished by a particularly high dynamic capability, i.e. a particularly high resistance to alternating stresses. The lightweight spun-bonded fabric can be used, for example, as a reinforcement for shoes and garments, as a carrier material for curtains and blinds, as seat covering, filter material, and the like.

13 Claims, No Drawings

SPUN-BONDED FABRIC CONSOLIDATED BY A HOT-MELT BINDER

Description

The invention relates to a spun-bonded fabric consolidated by a hot-melt binder, composed of load-bearing filaments and binder filaments of polyester, serving as the hot-melt binder.

Spun-bonded fabrics of this type are known, for example, from German Patent 2,240,437 and German Offenlegungsschrift 3,642,089. These previously known spun-bonded fabrics, in which both the load-bearing filaments and the binder filaments can be composed of polyesters, are used especially as reinforcing materials and carrier materials in the manufacture of needle-punched felt and of tufting. In the spun-bonded fabric according to German Patent 2,240,437, filaments of a relatively coarse individual titer of more than 8 dtex are used. The proportion of binder filaments is relatively high and amounts to 10 to 30%, preferably between 15 and 25%. In the spun-bonded fabric according to German Offenlegungsschrift 3,642,089, individual titers of 5 or 12 dtex are indicated in the examples; the proportion of the binder filaments is between 10 and 50%, preferably between 15 and 30%. The weight per unit area is stated to be greater than 120 g/m$^2$.

A similar spun-bonded fabric is described in German Offenlegungsschrift 3,419,675. This spun-bonded fabric, which is to be used as a reinforcing ply in roofing webs and sealing webs, contains load-bearing filaments of polyethylene glycol terephthalate and binder filaments of polybutylene glycol terephthalate. The proportion of the binder filaments should be 10 to 30%. In the examples, values of 100, 140 and 180 g/m$^2$ for the weight per unit area, 4.5 and 5.6 dtex for the individual titer and 10 to 30% for the proportion of binder filaments are indicated.

All these previously known spun-bonded fabrics are therefore relatively heavy spun-bonded fabrics of coarse titer with a comparatively high proportion of hot-melt binder.

It is the object of the invention to provide a spun-bonded fabric consolidated by a hot-melt binder, which is distinguished by a high dynamic capability, i.e. a high resistance to alternating stresses.

This object is achieved by a spun-bonded fabric consolidated by a hot-melt binder, of the generic type indicated at the outset, wherein the weight per unit area of the spun-bonded fabric is in the range between 20 and 120 g/m$^2$, the individual titer of the load-bearing filaments and of the binder filaments is in the range between 1 and 7 dtex and the proportion of the binder filaments is less than 10 percent by weight.

The spun-bonded fabric formed according to the invention is a lightweight spun-bonded fabric of comparatively fine titer, having a low weight per unit area and a low proportion of hot-melt binder. It has been found, surprisingly, that the lightweight spun-bonded fabric, formed according to the invention, possesses good strength properties in spite of a relatively low proportion of binder filaments. In particular, the spun-bonded fabric formed according to the invention is distinguished by a high dynamic capability. This means that the spun-bonded fabric can very well be exposed to an alternating stress, for example a folding stress. It is therefore particularly suitable as a reinforcement for shoes and garments or also for use in curtains and blinds. Evidently, the low weight per unit area and the small proportion of binder filaments as well as the comparatively fine filament titer in conjunction with the selected material pairing (polyester-polyester) are responsible for the high dynamic capability.

Preferably, the weight per unit area of the spun-bonded fabric is between 30 and 100 g/m$^2$, in particular 30 and 90 g/m$^2$, the individual titer of the filaments is between 1 and 5 dtex, in particular 1 and 4 dtex, and the proportion of binder filaments is between 5 and 10 percent by weight. The titer of the binder filaments is preferably selected to be smaller than the titer of the load-bearing filaments.

The load-bearing filaments are preferably composed of polyethylene terephthalate, whereas the hot-melt binder is composed of polymers whose melting point is more than 10° C., in particular more than 30° C., lower than the melting point of the load-bearing filaments. Preferably, polybutylene terephthalate or a modified polyethylene terephthalate having a suitably lowered melting point is used as the hot-melt binder.

In particular, at least the load-bearing filaments can be composed of polyesters modified to render them flame-retardant, such as are described, for example, in German Patent 2,346,787. Preferably, the binder filaments are also composed of a raw material modified to render it flame-retardant, for example of polybutylene terephthalate, especially such as is described in German Patent 2,526,749.

In a further embodiment of the invention, an antistatic such as, for example, carbon black is introduced into the spun-bonded fabric by means of the binder filaments.

The spun-bonded fabric formed according to the invention can, in particular, be produced with the use of a rotating impact plate and a downstream baffle surface, as described, for example, in German Patent 2,713,241. The fabric is preferably laid down by means of series-arranged rows of spinnerets, so that a layer structure of load-bearing filaments and binder filaments is formed. Expediently, the two outer layers do not contain any binder filaments.

Preferably, no needle-punching of the laid-down filaments takes place, but only a thermal preconsolidation such as is described, for example, in German Patent 3,322,936, and a subsequent final thermal consolidation, for example by means of a smooth or profiled roller. Particularly preferentially, the thermal consolidation is carried out by means of hot air, for example in sieve drum fixers with a downstream pair of embossing rollers.

The lightweight spun-bonded fabric formed according to the invention is free of resinous binders and therefore inherently of low flammability. As already mentioned, the low inflammability can be further improved by a suitable selection of raw materials modified to render them flame-retardant, for the load-bearing filaments and for the binder filaments. These flameproof lightweight spun-bonded fabrics can then also be used in rooms where there is a fire hazard, for example as carrier material for curtains, wallpapers or blinds, or as constituents for seat covers in vehicles or aircraft.

Particularly voluminous spun-bonded fabrics are obtained in the case of the smallest possible proportion of binder filaments and sieve/drum fixing. These spun-bonded fabrics then also have a surface structure with many fiber ends, which markedly increases the adhesion of coating materials of PVC or bitumen. Such voluminous spun-bonded fabrics having a fiber-rich surface are also suitable for the production of filter materials.

The addition of antistatics, carbon black in the simplest case, in the melting cylinder allows, furthermore, the use of the spun-bonded fabric formed according to the invention in zones where there is an explosion hazard or also as a filter medium for clean rooms.

The dye affinity of the hot-melt binder can be adapted to that of the load-bearing filaments by modifying the raw material for the hot-melt binder; alternatively, the differing dye affinities can also be exploited for interesting color effects.

We claim:

1. A non-needled spun-bonded fabric consolidated substantially only by a hot-melt binder, consisting essentially of load-bearing filaments and binder filaments of polyester, serving as the hot-melt binder, wherein the weight per unit area of the non-needled spun-bonded fabric is in the range between 20 and 120 g/m$^2$, the individual titer of the load-bearing filaments and of the binder filaments is in the range between 1 and 7 dtex and the proportion of the binder filaments is less than 10 percent by weight.

2. The spun-bonded fabric as claimed in claim 1, wherein the weight per unit area of the spun-bonded fabric is in the range between 30 and 100 g/m$^2$.

3. The spun-bonded fabric as claimed in claim 2, wherein the weight per unit area of the spun-bonded fabric is in the range between 30 and 90 g/m$^2$.

4. The spun-bonded fabric as claimed in claim 1, wherein the individual titer of the load-bearing filaments and of the binder filaments is in the range between 1 and 5 dtex.

5. The spun-bonded fabric as claimed in claim 4, wherein the individual titer of the load-bearing filaments and of the binder filaments is in the range between 1 and 4 dtex.

6. The spun-bonded fabric as claimed in claim 1, wherein the individual titer of the binder filaments is smaller than that of the load-bearing filaments.

7. The spun-bonded fabric as claimed in claim 1, wherein the proportion of the binder filaments is more than 5 percent by weight.

8. The spun-bonded fabric as claimed in claim 1, wherein the load-bearing filaments are composed of polyethylene terephthalate and the hot-melt binder is consisting essentially of polymers whose melting point is more than 10° C. below the melting point of the load-bearing filament.

9. The spun-bonded fabric as claimed in claim 8, wherein the melting point of the polymers is more than 30° C. below the melting point of the load-bearing filament.

10. The spun-bonded fabric as claimed in claim 9, wherein the hot-melt binder is composed of polybutylene terephthalate or a modified polyethylene terephthalate having a suitably lowered melting point.

11. The spun-bonded fabric as claimed in claim 1, wherein the load-bearing filaments and the binder filaments are composed of polyesters modified to render them flame-retardant.

12. The spun-bonded fabric as claimed in claim 1, wherein the binder filaments contain an antistatic agent.

13. The spun-bonded fabric as claimed in claim 12, wherein the antistatic agent comprises carbon black.

* * * * *